United States Patent [19]

Filippi et al.

[11] Patent Number: 4,870,940

[45] Date of Patent: Oct. 3, 1989

[54] INJECTION PUMP FOR FUEL INJECTION SYSTEMS WITH CONTROL LED INJECTORS FOR I.C. ENGINES

[75] Inventors: Renato Filippi, Vinovo; Mario Ricco, Bari, both of Italy

[73] Assignee: Weber S.r.l., Turin, Italy

[21] Appl. No.: 236,619

[22] Filed: Aug. 25, 1988

[30] Foreign Application Priority Data

Aug. 25, 1987 [IT] Italy ..... 67734 A/87

[51] Int. Cl.[4] ..... F02M 39/00

[52] U.S. Cl. ..... 123/506; 123/557; 123/514

[58] Field of Search ..... 123/506, 500, 501, 458, 123/557, 514, 516, 510

[56] References Cited

U.S. PATENT DOCUMENTS

| | | | |
|---|---|---|---|
| 1,664,608 | 4/1928 | French | 123/506 |
| 3,779,225 | 12/1973 | Watson | 123/506 |
| 4,411,239 | 10/1983 | Kelch | 123/557 |
| 4,454,851 | 6/1984 | Bourbonnaud | 123/557 |
| 4,502,450 | 3/1985 | Duprez | 123/557 |
| 4,502,451 | 3/1985 | Duprez | 123/557 |
| 4,586,656 | 5/1986 | Wich | 123/506 |
| 4,708,116 | 11/1987 | Gaa | 123/506 |
| 4,757,794 | 7/1988 | Hofer | 123/506 |
| 4,765,302 | 8/1988 | Ikeuchi | 123/506 |
| 4,770,150 | 9/1988 | Fraenkle | 123/557 |
| 4,785,987 | 12/1988 | Riszk | 123/506 |

FOREIGN PATENT DOCUMENTS

| | | | |
|---|---|---|---|
| 0069639 | 1/1983 | European Pat. Off. | 123/557 |
| 1153211 | 8/1963 | Fed. Rep. of Germany | 123/557 |
| 2386692 | 11/1978 | France . | |
| 360847 | 4/1962 | Switzerland . | |

*Primary Examiner*—Carl Stuart Miller

[57] ABSTRACT

An injection pump for fuel injection systems with controlled injectors for diesel engines, including at least one cylinder-and-piston pumping unit driven by a shaft with eccentrics and connected through an intake valve and a delivery valve to inlet and outlet means for the fuel. A solenoid pressure-regulating valve fitted directly to the body of the pump is interposed between the delivery means and the injectors.

1 Claim, 2 Drawing Sheets

Figure 3:
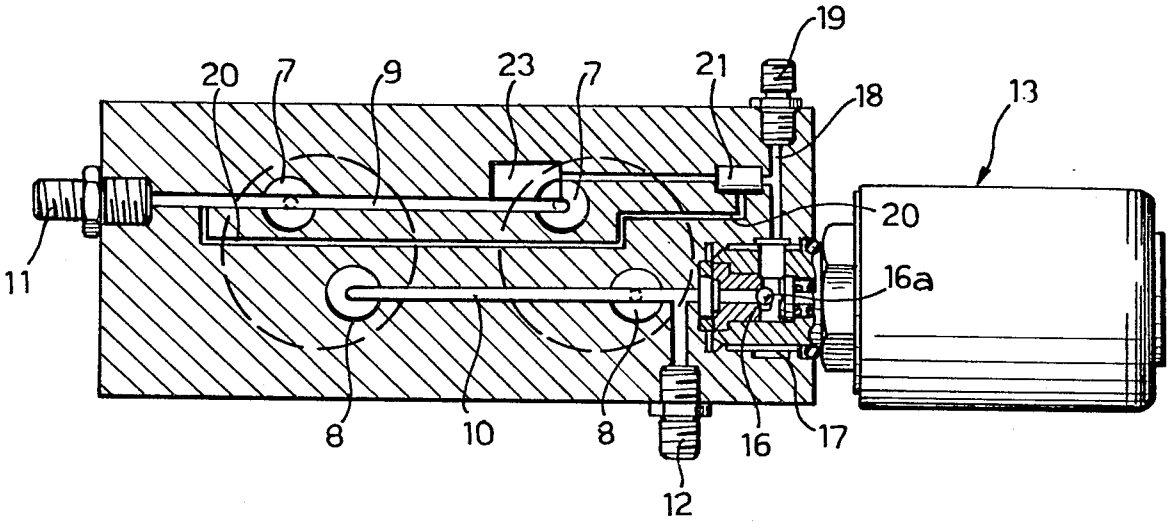

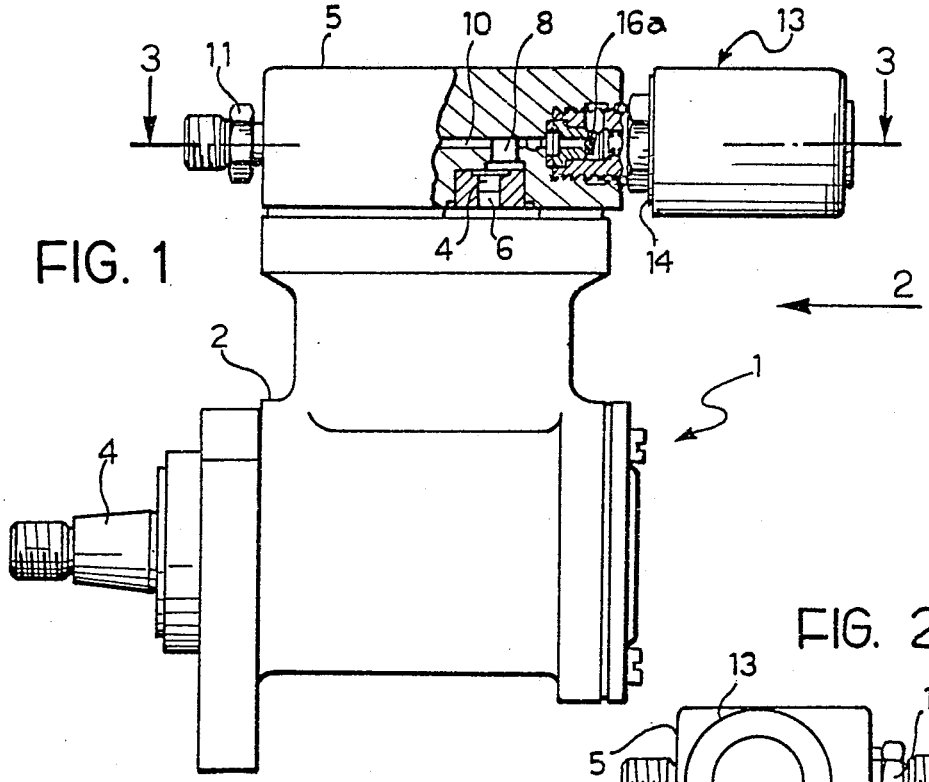
FIG. 1
FIG. 2
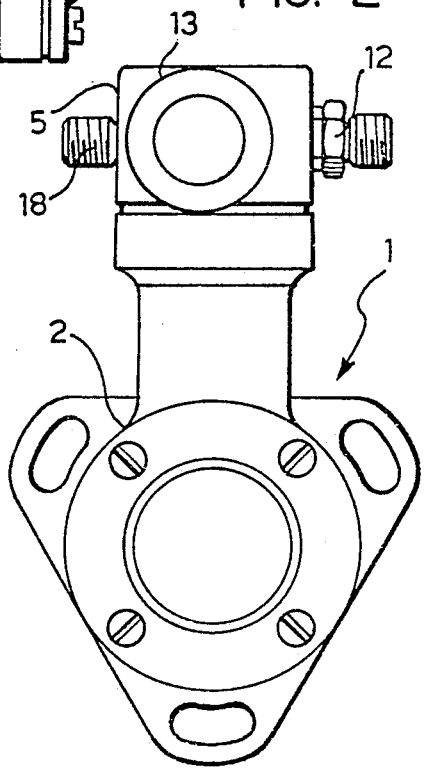

INJECTION PUMP FOR FUEL INJECTION SYSTEMS WITH CONTROL LED INJECTORS FOR I.C. ENGINES

The present invention relates generally to injection pumps for fuel injection systems with controlled injectors for i.c. engines for motor vehicles.

More particularly, the invention concerns an injection pump of the type comprising a body carrying at least one cylinder-and-piston pumping unit driven by a shaft with eccentrics and connected through an inlet valve and a delivery valve to inlet and outlet means for the fuel, and a solenoid pressure-regulating valve interposed between the outlet means and the injectors and including a body having an inlet and a discharge outlet the communication of which is controlled by a valve obturator whose closure can be varied by means of an electromagnetic actuator.

In injection pumps of the type defined above, there is on the one hand the problem of dissipation of the heat generated by the solenoid regulating valve during lamination of the fuel in the open condition of the respective valve obturator, and on the other hand the problem of ensuring the correct injection of the fuel by the injectors in low-temperature environments and/or operative conditions.

The object of the present invention is to resolve these problems jointly in a simple and effective manner and this object is achieved by virtue of the fact that the solenoid pressure-regulating valve is fitted directly to the body of the pump.

By virtue of this solution, effective dissipation of the heat generated by the solenoid regulating valve during lamination of the fuel is obtained, in that the body of the pump to which the solenoid regulating valve is fitted directly acts conveniently as a radiant mass for dissipating the heat. Moreover, this heat is transmitted through the body of the pump to the fuel drawn in through the pump inlet means, ensuring its useful preheating in every low-temperature operative condition, without the use of additional heaters or of complex insulated pipes.

In some conditions, in order to achieve additional direct heating of the fuel drawn in through the pump inlet means, the discharge outlet of the solenoid pressure-regulating valve is conveniently connected to the fuel inlet means through a branch passage formed in the body of the pump and with which a thermostatic control valve sensitive to the temperature of the fuel in the inlet means its operatively associated for interrupting communication between the solenoid regulating valve and the discharge outlet and for opening communication between the solenoid valve and the branch passage when the temperature of the fuel in the inlet means is below a predetermined value.

The invention can be applied advantageously to reciprocating injection pumps in general, whether of the in-line type or of the radial type.

The invention will now be described in detail with reference to the appended drawings, provided purely by way of non-limiting example, in which:

FIG. 1 is a partially-sectioned, schematic front elevational view of an injection pump according to the invention, FIG. 2 is a side elevational view taken on the arrow II of FIG. 1, and FIG. 3 is a cross-section taken on the line III—III of FIG. 1.

With reference to the drawings, a reciprocating injection pump for fuel injection systems with controlled injectors for diesel engines for motor vehicles is generally indicated 1. In the embodiment illustrated, the injection pump 1 is of the two-cylinder in-line type and includes a base 2 containing two cylinder-and-piston pumping units, schematically indicated 3, and a drive shaft with eccentrics 4 for driving the two pumping units 3.

Each of these pumping units 3 includes a cylinder 4 inserted in a head 5 applied to the top of the base 2, and a piston 6 reciprocable along the cylinder 4. Each cylinder 4 is associated with two valves, an intake valve 7 and a delivery valve 8 respectively, connected through respective passages 9, 10 formed in the head 5 to an inlet connector 11 and an outlet connector 12 for the fuel.

A solenoid pressure-regulating valve 13 is associated with the delivery of the pump 1 and includes a body 14 carrying an electromagnetic actuator, generally indicated 15, associated with a ball obturator 16a which controls communication between an inlet 16 and an outlet 17 of the valve 13. This valve, which will not be described in detail, may for example be of the type forming the subject of Italian Utility Model Application No. 54052-B/86 in the name of the same Applicants.

According to the invention, the body 14 of the solenoid valve 13 is fixed directly to the body of the pump 1, and in particular to the side of the head 5 opposite the inlet connector 11. The inlet 16 of the solenoid valve 13 communicates with the delivery passage 10 immediately downstream of the outlet connector 12, while the outlet 17 communicates with a discharge passage 18 connected in its turn to a discharge connector 19 in communication with the fuel tank. Moreover, the discharge passage 18 communicates with the inlet passage 9 connected to the intake valves 7 of the two pumping units 3 through a branch passage 20 also formed in the head 5.

A diverter valve, schematically indicated 21, is arranged to open and close communication between the outlet 17 of the valve 13 and the discharge connector 19, downstream of the branch passage 20. The valve 21 is controlled by means of a thermostatic actuator 23 sensitive to the temperature of the fuel in the inlet passage 9 and arranged to close the valve 23, and hence close communication between the passage 18 and the discharge connector 19, when the temperature detected in the passage 9 is below a predetermined threshold value. When the temperature reaches this threshold value, the thermostatic actuator 23 opens the valve 21 so as to connect the passage 18 to the discharge connector 19.

By virtue of the configuration described above, in operation of the pump, the heat generated during lamination of the fuel by the solenoid regulating valve 13 (controlled by an electronic control unit, not illustrated) is dissipated efficiently by the body of the pump 1 which acts as a radiant mass. The heat is transmitted to the fuel drawn in by the pumping units 3 through the passage 9 so as to ensure proper operation of the injection system even at a low temperature. The presence of the diverter valve 21 enables further effective preheating of the cold fuel to be achieved by means of the mixing, through the branch passage 20, of part of the fuel laminated by the valve 13 with that entering through the inlet passage 9. This preheating action is stopped when the valve 21 is closed by the thermostatic actuator 23 as the predetermined threshold temperature is reached.

Although the invention has been described with reference to a two-cylinder in-line pump, it is clear that it is also applicable with equal advantage to other types of injection pump, for example, reciprocating pumps of radial type.

We claim:

1. An injection pump for fuel injection systems with controlled injectors for diesel engines, comprising: a body carrying at least one cylinder-and-piston pumping unit driven by a shaft with eccentrics and connected through an intake valve and a delivery valve to inlet and outlet means for fuel, and a solenoid pressure-regulating valve interposed between the outlet means and the injectors and including a body having an inlet and a discharge outlet the communication of which is controlled by a valve obturator whose closure can be varied by means of an electromagnetic actuator, the solenoid pressure-regulating valve being fitted directly to the body of the pump, the discharge outlet of the solenoid pressure-regulating valve being connected to the fuel inlet means through a branch passage formed in the body of the pump and with which a diverter valve with a thermostatic control sensitive to the temperature of the fuel in the inlet means is operatively associated to interrupt the communication between the solenoid regulating valve and the discharge outlet and to open the communication between the solenoid regulating valve and the branch passage when the temperature of the fuel in the inlet means is below a predetermined threshold value.

* * * * *